US006718808B2

(12) United States Patent
Yu

(10) Patent No.: US 6,718,808 B2
(45) Date of Patent: Apr. 13, 2004

(54) TUBULAR-TYPE LOCKING CYLINDER AND DEDICATED KEY

(76) Inventor: Chin-Shen Yu, No. 8, Alley 11, Lane 116, Shuang-Feng Road, Shing-Juang City, Taipei Hsien (TW)

( * ) Notice: Subject to any disclaimer, the term of this patent is extended or adjusted under 35 U.S.C. 154(b) by 0 days.

(21) Appl. No.: 10/455,288

(22) Filed: Jun. 3, 2003

(65) Prior Publication Data

US 2003/0226385 A1 Dec. 11, 2003

(51) Int. Cl.[7] ..... E05B 27/08

(52) U.S. Cl. ..... 70/491; 70/386; 70/404; 70/419

(58) Field of Search ..... 70/386, 403, 404, 70/419, 491

(56) References Cited

U.S. PATENT DOCUMENTS

| | | | | | |
|---|---|---|---|---|---|
| 3,961,507 | A | * | 6/1976 | Falk | 70/491 |
| 4,012,931 | A | * | 3/1977 | Harunari | 70/496 |
| 4,450,697 | A | * | 5/1984 | Ellis | 70/178 |
| 4,621,510 | A | * | 11/1986 | Scherbing | 70/491 |
| 5,020,349 | A | * | 6/1991 | Lee | 70/491 |
| 5,121,618 | A | * | 6/1992 | Scott | 70/367 |
| 5,402,660 | A | * | 4/1995 | Osada | 70/491 |
| 5,829,280 | A | * | 11/1998 | Chen | 70/49 |
| 6,038,898 | A | * | 3/2000 | Cliff | 70/491 |
| 6,125,673 | A | * | 10/2000 | Luker | 70/276 |
| 6,357,271 | B1 | * | 3/2002 | Hsu | 70/491 |
| 6,550,299 | B1 | * | 4/2003 | Lin | 70/491 |
| 6,584,819 | B1 | * | 7/2003 | Hung | 70/491 |

FOREIGN PATENT DOCUMENTS

| | | | | |
|---|---|---|---|---|
| GB | 1384222 | * | 2/1975 | 70/491 |
| IT | 532372 | * | 8/1955 | 70/491 |

* cited by examiner

*Primary Examiner*—Lloyd A. Gall

(57) ABSTRACT

An improved tubular-type locking cylinder and dedicated key that provides for both theft- and trip-resistant tumbler pin assemblies, wherein the locking cylinder is comprised of an outer housing, a main base, a locking cylinder shaft, and a plurality of tumbler pin assemblies. The improved features are that a detent slot is formed in the interior wall along the locking cylinder shaft recess through the center of the main base body. The locking cylinder shaft consists of a bore through the center of the shaft member up to its top extremity, a movably disposed catch bolt and spring, and a plug obstructing the opening of the bore. A horizontal passage for seating a steel ball is formed in the shaft member at the lower side of a tumbler pin disc. A locating pin is horizontally situated near the upper extremity at one side of the catch bolt. A keyway slot is formed in the shaft member that is contiguous to the upper end of the bore. As such, the locating pin on the catch bolt is inserted into the keyway slot, but remains capable of upward and downward movement within the keyway slot. The key of the invention herein is comprised of a toggling barrel and a handle, the toggling barrel having a locating element at the outer side of its rim and an actuating element facing the inside, the innovative feature being an indentation of a certain depth disposed in the rim at the outer extremity of the actuating element.

2 Claims, 7 Drawing Sheets

TUBULAR-TYPE LOCKING CYLINDER AND DEDICATED KEY

BACKGROUND OF THE INVENTION

1) Field of the Invention

The invention herein relates to lock mechanisms, specifically an improved tubular-type locking cylinder and dedicated key having both theft- and trip-resistant tumbler pin assemblies.

2) Description of the Prior Art

A conventional tubular-type locking cylinder 1*a* and key 2*a* is shown in FIG. 5 and FIG. 6. The said conventional tubular-type locking cylinder 1*a* is typically comprised of an outer housing 11, a main base 12*a*, a locking cylinder 13*a*, and a plurality of tumbler pin assemblies 14, while the key 2*a* of the said conventional tubular-type locking cylinder 1*a* is of one-piece construction and comprised of a toggling barrel 21 and a handle 22. The said toggling barrel 21 consists of a barrel member 210 having a plurality of arcuate unlocking notches 211 disposed along its outer rim, a locating element 214 extending outward laterally from the handle 22 member 220 at the said rim after the handle 22 is fastened to one side of the said rim, and, furthermore, an actuating element 213 facing inward. When the said key 2*a* is inserted into the entrance of the toggling barrel 21, the actuating element 213 and the locating element 214 on the outer side are respectively aligned with the actuating element slot 133 (see FIG. 6) at the top extremity of the locking cylinder shaft 13 of the said tubular-type locking cylinder 1*a* and the locating slot 112 on the key entry hole 111 of the outer housing 11 and then pushed into the said tubular-type locking cylinder 1*a* (as shown in FIG. 7), the plurality of arcuate unlocking notches 211 on the rim of the said toggling barrel 21 then contact the upper and lower pins 141 and 142 of the tumbler pin assemblies 14 at the lower extent of the locking cylinder 13*a* tumbler pin disc 131 and also moves against the upper extent of the main base 12*a* body 120*a* (as shown in FIG. 7), at which time the handle 22 of the said key 2*a* is grasped by two fingers and rotated clockwise or counter-clockwise such that the said key 2*a* unlocks the said tubular-type locking cylinder 1*a*.

Generally speaking, the said conventional tubular-type locking cylinder 1*a* has no drawbacks during the unlocking operation. However, since the plurality of tumbler pin assemblies 14 between the tumbler pin disc 131 of the locking cylinder 13*a* and the body 120*a* of the main base 12*a* lack any anti-theft device, an ordinary thief can easily obtain a tube having a wall thickness of approximately 0.2 mm to 0.4 mm and an inner diameter equal to the that of the key 2*a* toggling barrel 21, slip a rubber sleeve tightly over the exterior wall of the said tube to fix a number of wire segments or half-length toothpicks equal in quantity to that of the said tumbler pin assemblies 14 and insert this into the said conventional tubular-type locking cylinder 1*a* in place of the key 2*a* to forcefully unlock the said conventional tubular-type locking cylinder 1*a* within five seconds. As such, the prior art is merely an average, low-price, and imprecise locking device that is not equipped with a means of theft prevention. Additionally, since the said conventional tubular-type locking cylinder 1*a* has no anti-theft device or locking cylinder 13*a* securing device, when utilized as a lock under vibrational conditions, vibrations readily rotate the locking cylinder 13*a* against the main base 12 and trip the said tumbler pin assemblies 14, causing the said conventional tubular-type locking cylinder 1*a* to malfunction or become damaged such that it is inoperable.

Based on many years of professional engagement in the tubular lock manufacturing industry, the applicant of the invention herein addressed the installation and utilization shortcomings of the conventional tubular-type locking cylinder 1*a* by conducting research and testing that culminated in the successful development of the improved tubular-type locking cylinder and dedicated key of the invention herein.

SUMMARY OF THE INVENTION

The objective of the invention herein is to provide an improved tubular-type locking cylinder and dedicated key that has theft- and trip-resistant tumbler pin assemblies, the detailed description of which is presented after the brief description of the drawings below.

DETAILED DESCRIPTION OF THE INVENTION

Figure 1:
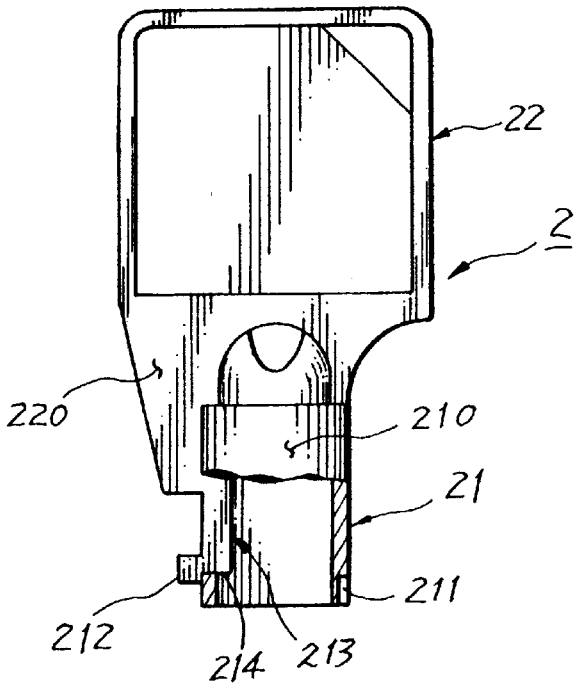
FIG. 1 is a cross-sectional drawing of the tubular-type locking cylinder and the key of the invention herein.
Figure 1:
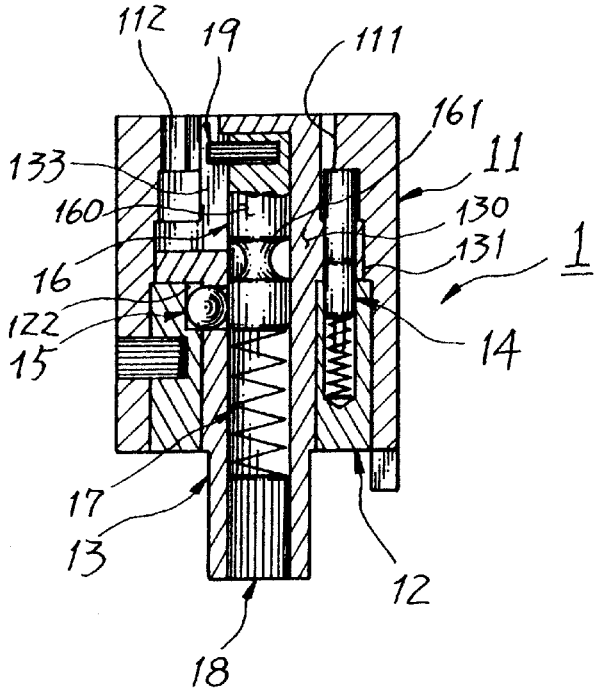
Figure 2:
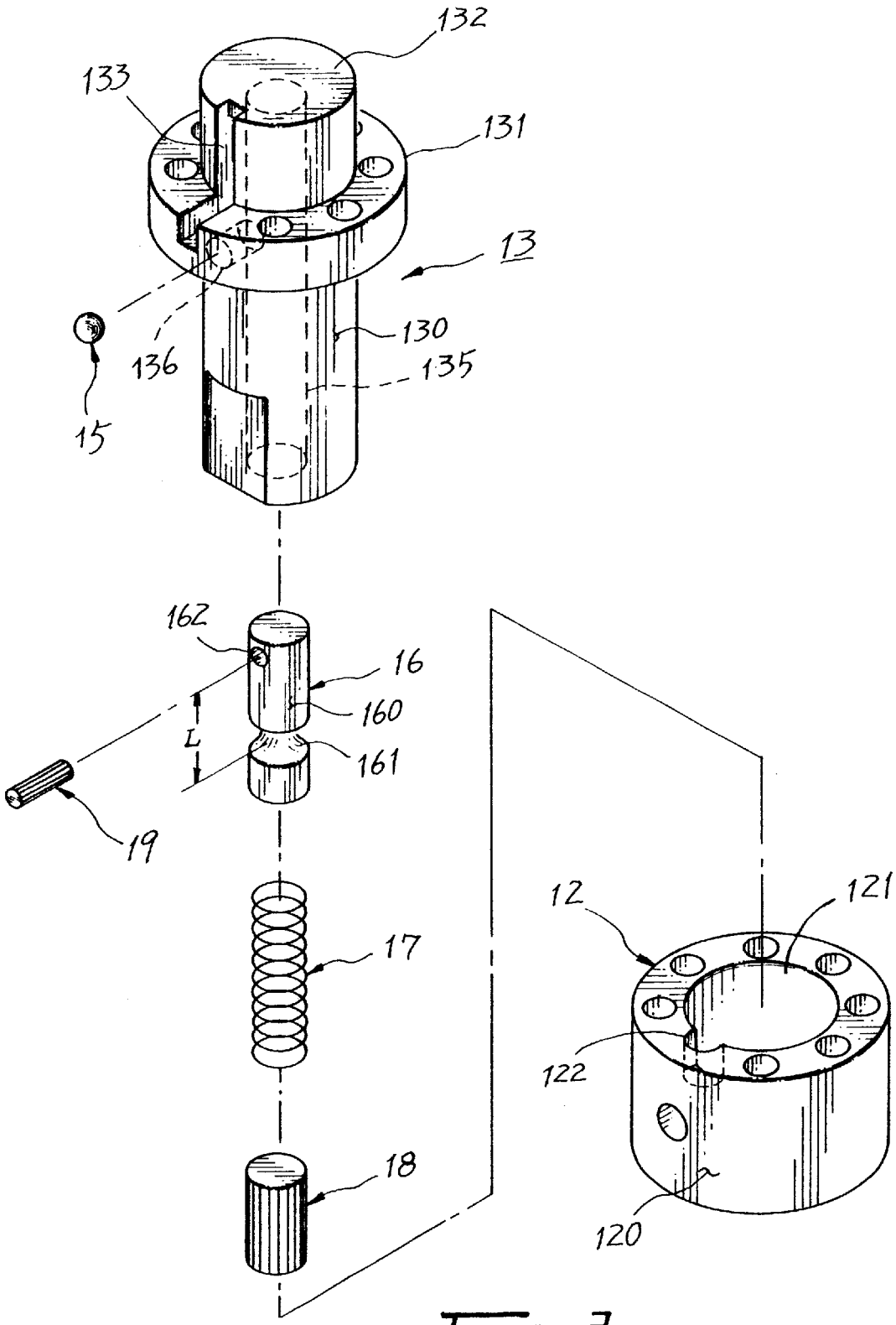
FIG. 2 is an exploded drawing of the improved structural components of the invention herein.

Referring to FIG. 1 and FIG. 2, similar to the said conventional tubular-type locking cylinder 1*a*, the tubular-type locking cylinder 1 of the invention herein is comprised of an outer housing 11, a main base 12, a locking cylinder shaft 13, and a plurality of tumbler pin assemblies 14; comparable to the key 2*a* of the said tubular-type locking cylinder 1, the key 2 of the invention herein is comprised of a toggling barrel 21 and a handle 22. The improved features are that a detent slot 122 for emplacing a steel ball 15 is additionally formed in the interior wall along a locking cylinder shaft recess 121 through the center of the main base 12 body 120. The said locking cylinder shaft 13 consists of a bore 135 through the center of the shaft member 130 up to its top extremity 132, a movably disposed catch bolt 16 and spring 17, and a plug 18 obstructing the opening of the said bore 135; a horizontal passage 136 for seating the steel ball 15 is fabricated in the shaft member 130 at the lower side of a tumbler pin disc 131; and a keyway slot 133 is formed in the said shaft member 130 that is contiguous to the upper end of the bore 135.

A locating pin 19 is horizontally situated near the upper extremity at one side of the said catch bolt 16 such that when the locking cylinder shaft 13 is placed into the bore 135, the locating pin 19 on the catch bolt 16 is inserted into the keyway slot 133 and capable of upward and downward movement within the keyway slot 133. When the locking cylinder shaft 13 and the main base 12 of the invention herein are assembled together, the steel ball 15 must first be put into the horizontal passage 136 of the shaft member 130 and then the steel ball 15 aligned with the detent slot 122 in the main base 12 body 120 and inserted into the said body 120. An arcuately profiled annular groove 161 is formed around the catch bolt 16 bolt member 160 that is utilized to receive the said steel ball 15; a distance L (as shown in FIG. 2) is defined between the center of the said arcuately profiled annular groove 161 and the center of a hole 162 in the upper end of the said bolt member 160 for inserting the locating pin 19, with the said distance variable to accommodate a wide range of key 2 types. The key 2 of the invention herein has a cast or punched indentation 214 in the actuating element 213 at its outer extremity that matches differing distances of L between the said center of the locating pin 19 in the catch bolt 16 bolt member 160 and the center of the arcuately profiled annular groove 161.

Figure 3:
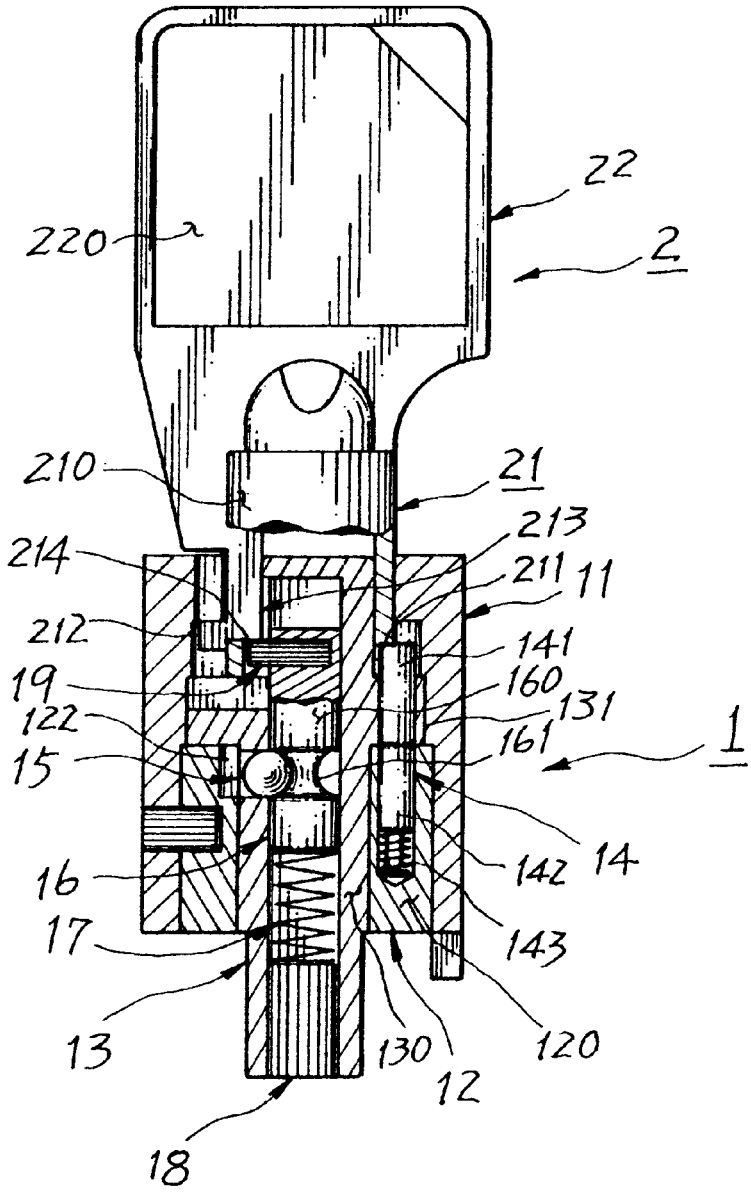
FIG. 3 is a cross-sectional drawing that illustrates the unlocking operation of the invention herein.
Figure 4:
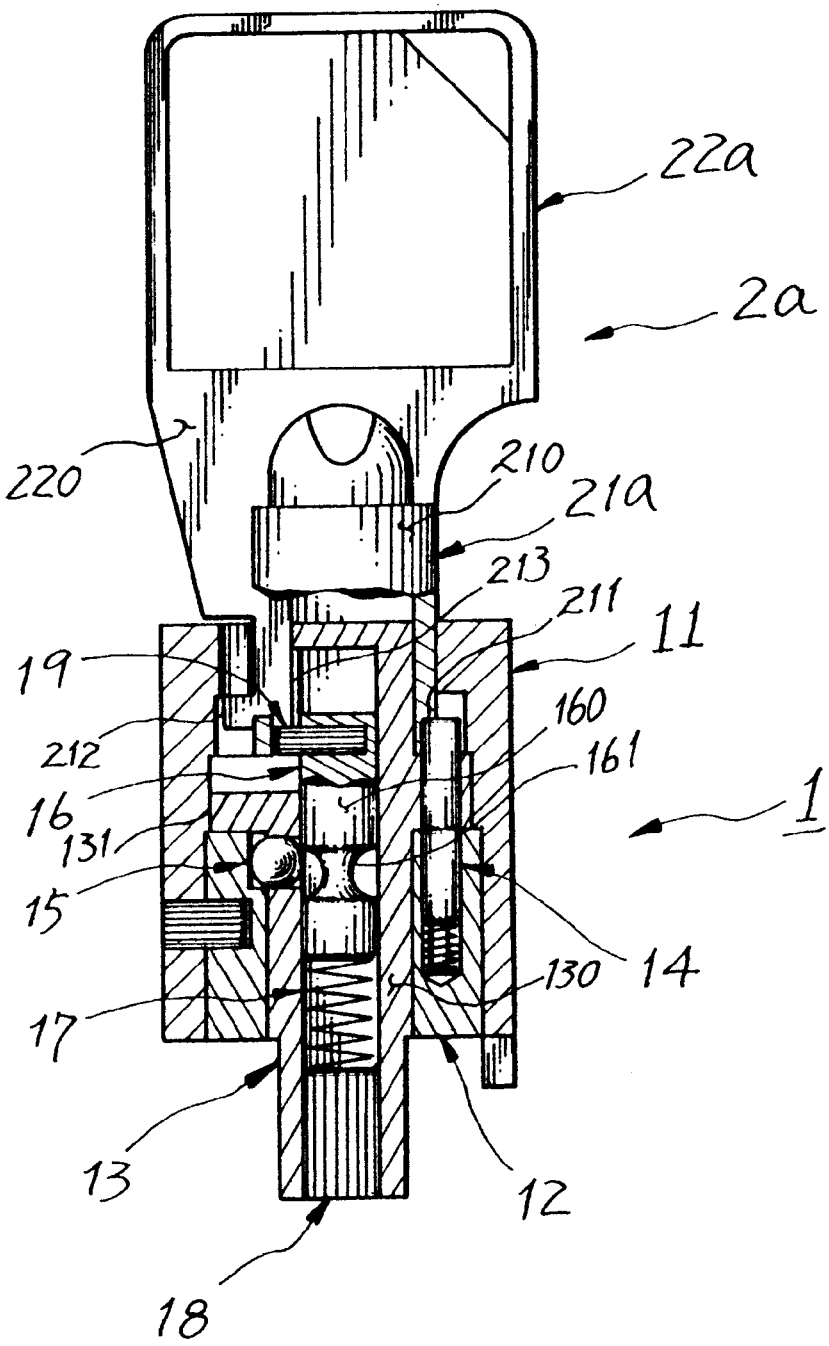
FIG. 4 is a cross-sectional drawing of a conventional tubular-type key incapable of unlocking the tubular-type locking cylinder of the invention herein.
Figure 5:
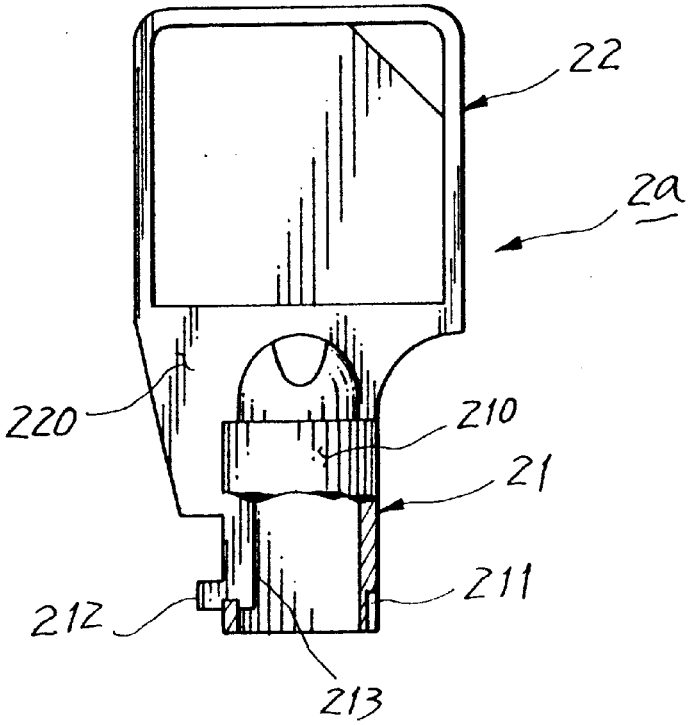
Fig. 5 PRIOR ART
FIG. 5 is a cross-sectional drawing of a conventional tubular-type locking cylinder and key
Figure 5:
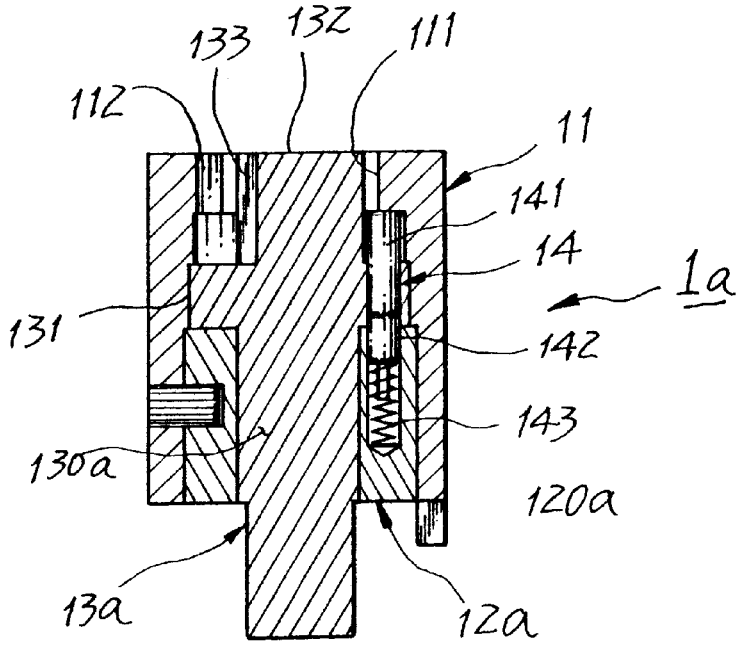
Fig. 5 PRIOR ART
Figure 6:
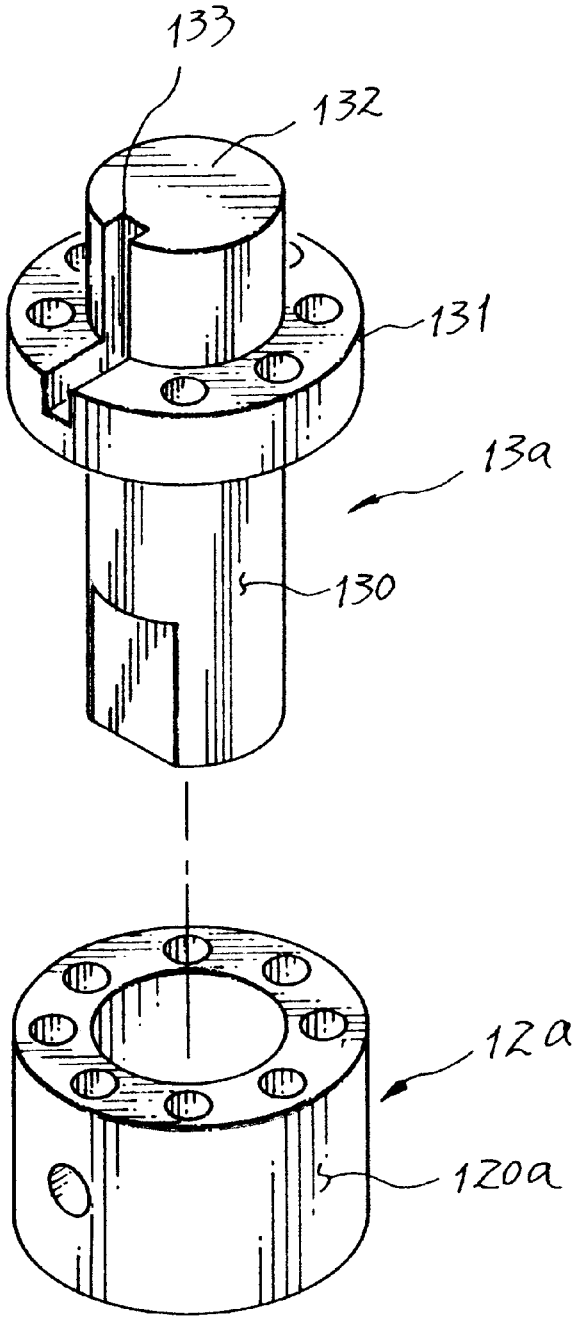
Fig- 6 PRIOR ART
FIG. 6 is an isometric drawing of the locking cylinder shaft and the main base section components of a conventional tubular-type locking cylinder.
Figure 7:
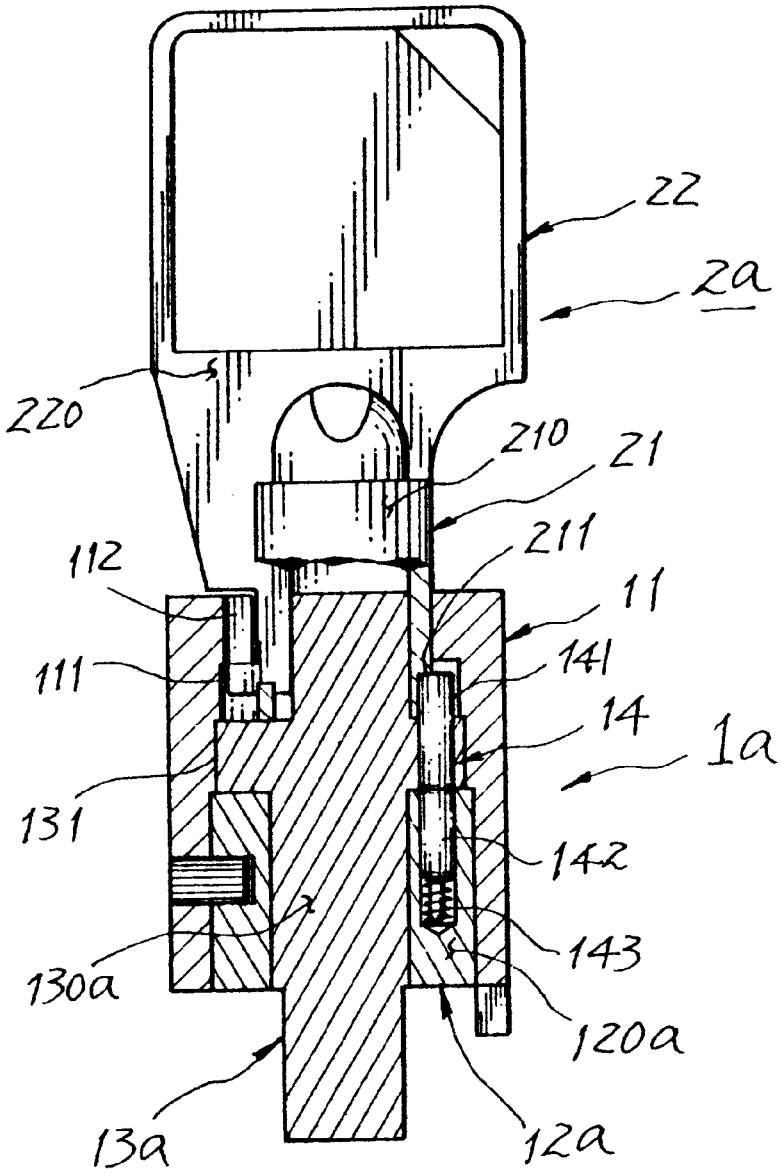
Fig- 7 PRIOR ART
FIG. 7 is a cross-sectional drawing of that illustrates the unlocking operation of a conventional tubular-type locking cylinder.

As the tubular-type locking cylinder 1 of the invention herein involves movably disposing the catch bolt 16 and the spring 17 within the shaft member 130 of the locking cylinder shaft 13 and, at the same time, seating the steel ball 15 inside the horizontal passage 136 formed in the shaft member 130, when it is in the locked state (as shown in FIG. 1), since the said steel ball 15 is not aligned with the arcuately profiled annular groove 161 of the catch bolt 16 but nested in the detent slot 122 on the body 120 of the main base 12 such that the locking cylinder shaft 13 cannot be rotated due to the engagement of the said steel ball 15 with the said main base 12 body 120, dislodging or jamming cannot occur due to physical vibration (as in the case of automotive, motorcycle, and other vehicle locks). Additionally, since the tubular-type locking cylinder 1 of the invention herein is of the said improved structural arrangement, the said tubular-type locking cylinder 1 can only be unlocked by the specially designed key 2, the said key 2 having a plurality of unlocking notches 211 that must numerically match the tumbler pin assemblies 14 and, furthermore, the depth of the casted or punched indentation 214 in the actuating element 213 at the outer extremity must conform to the distance L between the said arcuately profiled annular groove 161 on the catch bolt 16 and the locating pin 19 such that only it can be inserted into the tubular-type locking cylinder 1 (as shown in FIG. 3) for the unlocking operation, at which time the interfacing surfaces of the upper and lower tumbler pins 141 and 142 become respectively positioned against the lower extent of the locking cylinder shaft 13 tumbler pin disc 131 and the upper extent of the main base 12 body 120; the indentation 214 in the outer extremity of the actuating element 213 pushes the locating pin 19 on the said catch bolt 16, the said catch bolt 16 then shifting downward and becoming positioned in line with the said steel ball 15 within the arcuately profiled annular groove 161 of the said catch bolt 16, thereby enabling the turning of the key 2 clockwise and/or counter-clockwise to unlock the tubular-type locking cylinder 1 of the invention herein; if a conventional tubular key 2*a* is inserted into the tubular-type locking cylinder 1 of the present invention, although the plurality of arcuate unlocking notches 211 on the toggling barrel 21 completely fit the plurality of arcuate unlocking notches 211 on the toggling barrel 21 of the key 2 of the invention herein, the absence of the casted or punched indentation 214 in the actuating element 213 at the outer extremity precludes the possibility of articulating the steel ball 15 into the arcuately profiled annular groove 161 of the said catch bolt 16 movably disposed in the locking cylinder shaft 13 of the said locking cylinder 1, thereby preventing the clockwise and/or counter-clockwise rotation of said conventional key 2*a* when inserted in the improved tubular-type locking cylinder 1 of the invention herein. By utilizing the plurality of unlocking notches 211 on the said toggling barrel 21 as well as the tubular key 2 of the invention herein, an otherwise similar conventional tubular key 2*a* cannot unlock the improved tubular-type locking cylinder 1 of the invention herein and, furthermore, the improved tubular-type locking cylinder 1 cannot be easily unlocked with skeleton keys or lock picking tools by most thieves, therefore, the improved tubular-type locking cylinder 1 of the invention herein is effectively theft-resistant.

What is claimed is:

1. An improved tubular-type locking cylinder and dedicated key comprised of an outer housing, a main base, a locking cylinder shaft, and a plurality of tumbler pin assemblies, while the key of the invention herein is comprised of a toggling barrel and a handle; the said main base consists of a body having a locking cylinder shaft recess through the center; the said locking cylinder shaft consists of a shaft member having a tumbler pin disc and a keyway slot is formed in one side up to the top end; the said toggling barrel of the said key consists of a locating element at the outer side of its rim and an actuating element facing the inside, the features of which are:

A detent slot is formed in the opening of the said locking cylinder shaft recess of the said main base body;

The said locking cylinder shaft consists of:

A bore through the center of the said shaft member up to its top extremity and, furthermore, the keyway slot fabricated in the said shaft member that is contiguous to the upper end of the said bore;

A catch bolt and a spring movably disposed in the said bore and checked by a plug;

A locating pin laterally inserted into the said keyway slot near one side at the upper end of the said catch bolt;

A horizontal passage formed in the said shaft member at the lower side of the said tumbler pin disc that is also contiguous with the said bore;

A steel ball placed into the said horizontal passage;

The said key has an indentation of predetermined depth in the said actuating element at its outer extremity.

2. As mentioned in claim 1 of the improved tubular-type locking cylinder and dedicated key of the invention herein, the said catch bolt has an arcuately profiled annular groove and the distance between it and the said locating pin is matched by the depth of the said indentation in the rim of the said actuating element at the outer extremity of the said key and, furthermore, the said depth is variable to accommodate different distances.

* * * * *